US007259655B1

(12) United States Patent
Potts

(10) Patent No.: US 7,259,655 B1
(45) Date of Patent: Aug. 21, 2007

(54) SERVICE ATTENDANT SIGNALLING DEVICE

(76) Inventor: J. Douglas Potts, 455 White Birch Way, Hazelwood, MO (US) 63042

( * ) Notice: Subject to any disclaimer, the term of this patent is extended or adjusted under 35 U.S.C. 154(b) by 132 days.

(21) Appl. No.: 11/103,180

(22) Filed: Apr. 11, 2005

(51) Int. Cl.
*G08B 5/36* (2006.01)

(52) U.S. Cl. ..... 340/286.09; 340/321; 340/331; 340/332

(58) Field of Classification Search ..... 340/321, 340/286.09, 331, 332
See application file for complete search history.

(56) References Cited

U.S. PATENT DOCUMENTS

| | | | | |
|---|---|---|---|---|
| 2,547,450 A | | 4/1951 | Du Pont | 222/113 |
| 2,565,980 A | | 8/1951 | Moore | 340/321 |
| 3,316,396 A | * | 4/1967 | Bulcroft et al. | 362/186 |
| 3,750,317 A | * | 8/1973 | Morgan | 283/103 |
| 3,967,274 A | | 6/1976 | Howell | 340/815.42 |
| 4,250,491 A | | 2/1981 | Dotson | 340/321 |
| 5,211,699 A | * | 5/1993 | Tipton | 362/101 |
| 5,504,663 A | | 4/1996 | Tucker | 362/101 |
| 5,699,039 A | | 12/1997 | Korzen | 340/311.1 |
| 5,879,068 A | | 3/1999 | Menashrov et al. | 362/101 |
| 6,352,352 B1 | | 3/2002 | Schletterer et al. | 362/183 |
| 6,511,197 B1 | | 1/2003 | Kalemjain | 362/101 |
| 6,793,362 B2 | | 9/2004 | Tai | 362/101 |
| 2004/0004829 A1 | | 1/2004 | Policappelli | 362/101 |
| 2004/0017678 A1 | | 1/2004 | Liu | 362/101 |
| 2004/0264171 A1 | | 12/2004 | King et al. | 362/101 |

* cited by examiner

*Primary Examiner*—Brent A. Swarthout
(74) *Attorney, Agent, or Firm*—Grace J. Fishel

(57) ABSTRACT

A signal device for attracting the attention of a service provider. The signal device has a body with a tapered base adapted to fit into a neck of a bottle and a slot in a lower end of the base for balancing the signal device on a rim of a drinking vessel. An intermittent light source is provided in the top of the body.

3 Claims, 4 Drawing Sheets

SERVICE ATTENDANT SIGNALLING DEVICE

BACKGROUND OF THE INVENTION

1. Field of the Invention

The present invention relates to a signal device for use on a bottle, glass, cup, mug, pitcher or other drink container for the purpose of attracting the attention of a service attendant.

2. Brief Description of the Prior Art

It is believed by many proprietors of bars and lounges that sales of drinks are lost because the customer cannot attract the attention of a service attendant to place an order. Restaurants and other proprietors of beverages or food experience similar problems.

After serving a drink in a bar or lounge, service attendants, in general, will not return to a table for at least half an hour as it takes a person about thirty minutes, on average, to consume a drink. When the beverage being consumed is beer in dark bottles, it is not possible for the service attendant to see how much of the drink remains from a distance. Service attendants do not want to bother the customer by asking too soon as they do not want to waste their efforts since tips form a large part of their compensation.

There are many reasons why it may take a particular customer less than thirty minutes to finish his or her drink and be ready for another. Establishing eye contact with a service attendant who is busy serving other tables typically is very difficult. The situation breeds frustration for the proprietor in lost sales, the service attendant in lost tips and the customer who is under serviced.

When the customer wants to leave and obtain the check, it may also be difficult to attract the attention of the service attendant. In this instance, a major loser is the service attendant as the tip may decrease in proportion to the time the customer is kept waiting.

In view of the above, it would be desirable to have a device for discretely signaling a service attendant that service is needed. It would also be desirable that the device be inexpensive enough that it could be given away as a form of advertisement and promotion bearing the name of the establishment or the trademark of the drink being consumed. Further, it would be desirable that the device be pocket- or purse-sized such that the customer could carry it for use in establishments where no signaling device is provided.

The prior art includes lamps and flashlights and enunciator devices for signaling a waiter or waitress. These devices, however, are too expensive, impractical or ineffective for their intended purpose.

BRIEF SUMMARY OF THE INVENTION

In view of the above, it is an object of the present invention to provide a portable device for signalling a service attendant. It is another object to provide a signal device that can be used as a promotional item. It is also an object to provide a signal device that is effective and fun to use. Other objects and features of the invention will be in part apparent and in part pointed out hereinafter.

In accordance with the invention, a signal device for use on a drinking vessel to summon a service attendant has a body with a tapered base. The base is sized to fit into a neck of a bottle, such as a beer or soda bottle, and has a slot in the bottom by which the signal device can be balanced on the rim of a drinking vessel. An intermittent light source is provided in the body.

In a preferred embodiment, the light source is at least two spaced apart light emitting diodes connected to a power source through a pulse control circuit for independently blinking the diodes. Because the diodes are spaced apart, when they are independently blinked, the light source looks like it is moving, making it easier for the service attendant to see the signal even in a lighted room.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
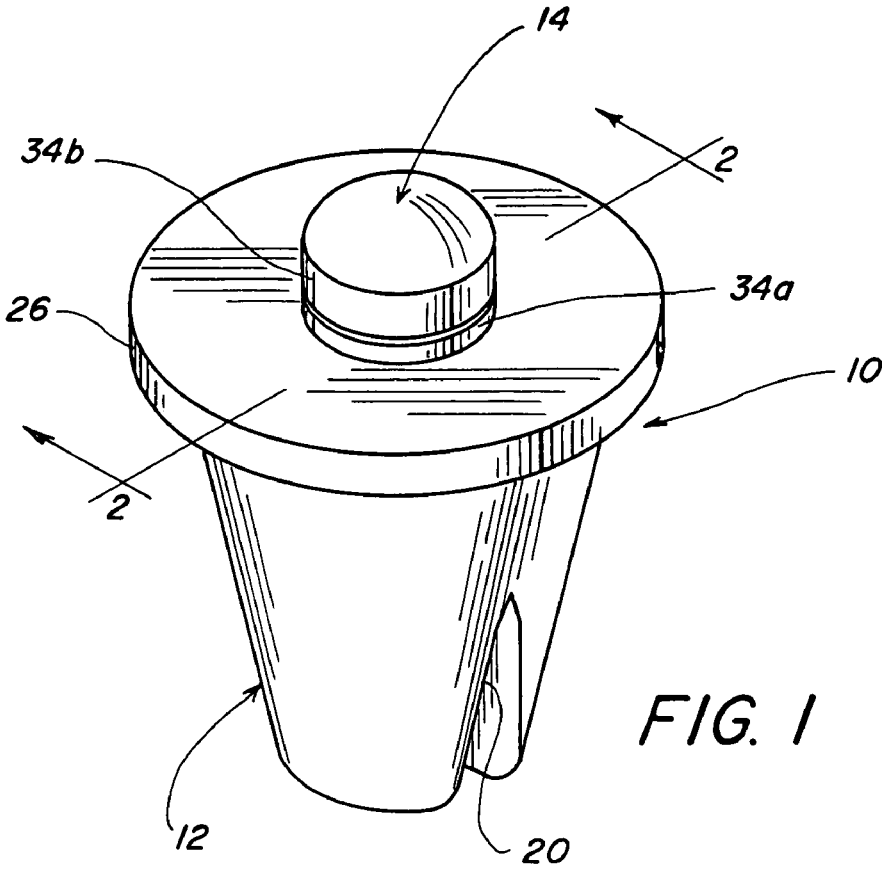
FIG. 1 is a perspective view of a signal device for a signalling a service attendant in accordance with the present invention.
Figure 2:
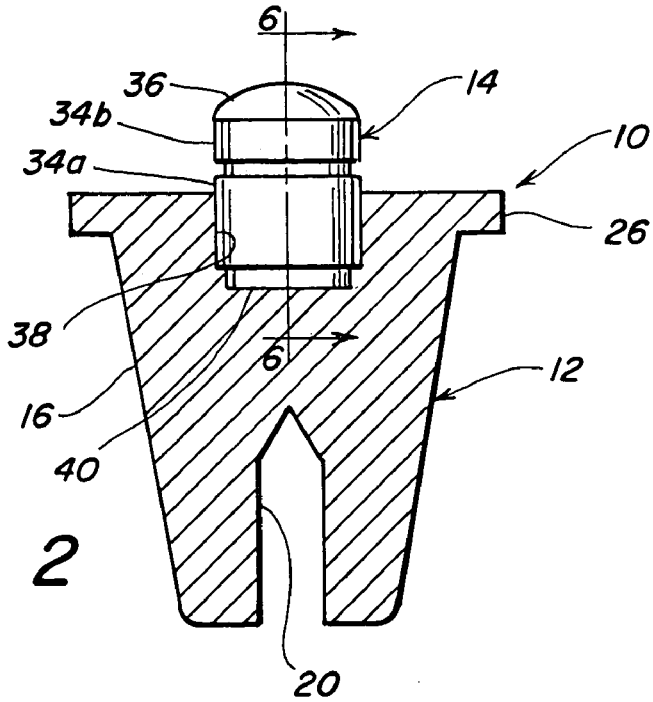
FIG. 2 is a cross-section of the signal device taken along the plane of 2-2 in FIG. 1.
Figure 3:
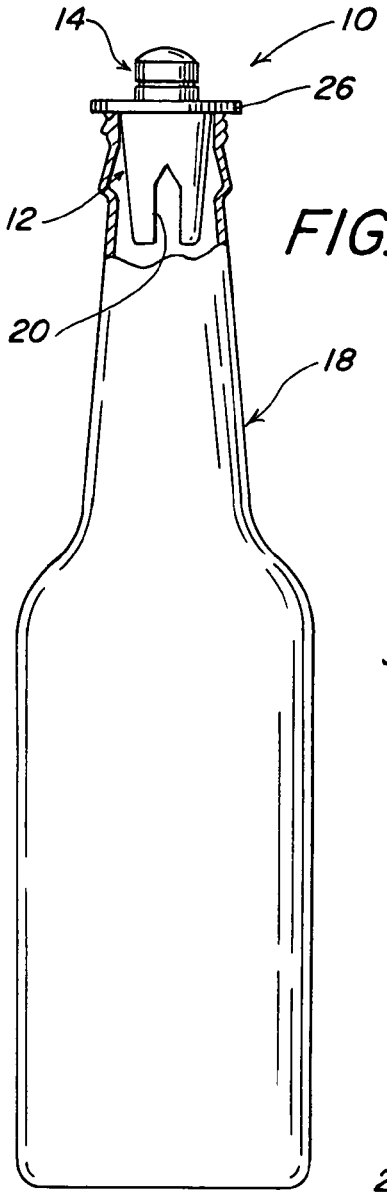
FIG. 3 is a side elevation, partly in section, showing the signal device inserted into the neck of a drinking vessel such as a beer or soda bottle or wine bottle.
Figure 4:
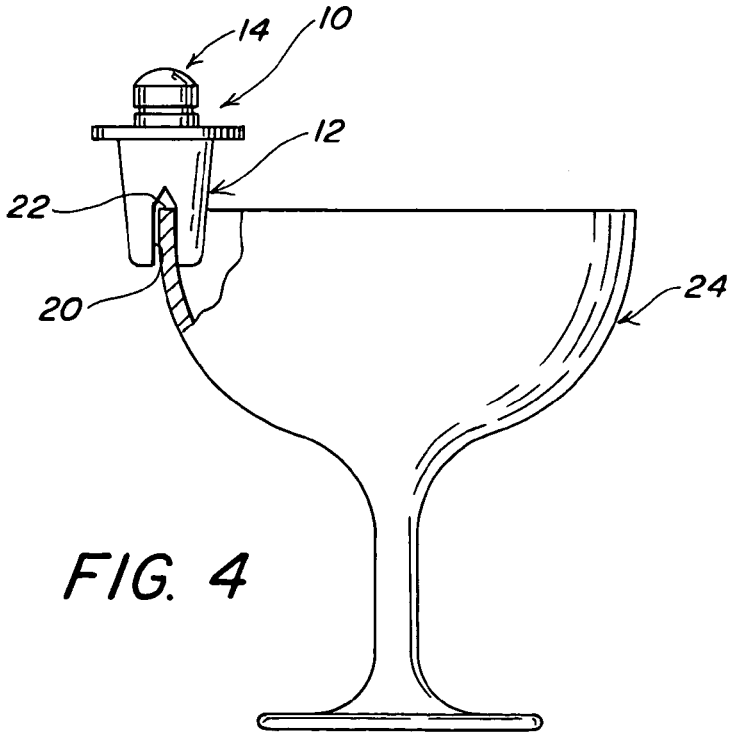
FIG. 4 is a side elevation, partly in section, showing the signal device perched on the rim of a glass.

Referring to the drawings more particularly by reference character, reference numeral 10 refers to a signal device in accordance with the present invention. Signal device 10 includes a body 12 and an intermittent light source 14 for summoning a service attendant. Body 12 has a tapered base 16 which is adapted to fit into a neck of a beer or soda bottle 18 as shown in FIG. 3. Tapered base 16 causes signal device 10 to roll in a circle when it is dropped so that it does not tend to fall off a table. A slot 20 is formed in a lower end of base 16 such that signal device 10 can be balanced on a rim 22 of a drinking vessel such as cocktail glass 24 shown in FIG. 4. Slot 20 may also be used to mount signal device 10 on the rim of a beer or wine bottle, coffee cup, pitcher, bucket or other drinking vessel. As illustrated, slot 20 has generally straight sidewalls joined to a V-shaped bottom.

For use in beer and soda bottles 18, it has been found that signal device 10 will fit most bottles when base 16 has a maximum diameter of about ¾ inch. For use on a wider range of drink containers, an upper end of base 16 may be joined to a flange 26 large enough that base 16 cannot slip through the neck of a wine bottle or the like. For this purpose, flange 26 may have a diameter of about 1 inch.

Intermittent light source 14 includes a light emitting diode 28 or other low-power consuming light source, a power source 30 which may be a battery and a mechanism 32 for activating and deactivating the light source. Light source 14 preferably includes at least two spaced apart LEDs 28*a*, 28*b* such that when they are independently blinked, light source 14 appears to be moving.

Intermittent light source 14 may be housed within a compartment 34, a lower section 34*a* of which may house one or more batteries 30*a*, 30*b* linked in series and an upper section 34*b* which may house LEDs 28*a*, 28*b*. A protective dome 36 formed of clear plastic or other light-conducting material may be provided over LEDs 28*a*, 28*b* for the purpose of conducting the light generated by the LEDs to the exterior of compartment 34.

Compartment 34 may be embedded in a socket 38 provided in an upper surface of body 12. Body 12 is preferably made of plastic, metal or other dishwasher safe material. When compartment 34 is not watertight, it may be detachable from socket 38 such that body 12 may be washed. When compartment 34 is made of a magnetic material, a magnet 40 may be provided in the base of socket 38. Other means for securing compartment 34 in socket 38 include friction fitting, bayonet locks, screw threads and so forth.

In a preferred embodiment of the present invention, batteries 30*a*, 30*b* may be standard "button" cells, similar to those used in electronic games, calculators, etc. However, it should be understood that other battery types may be used in place of the coin-shaped batteries shown in the drawings, in an appropriate design.

Figure 5:
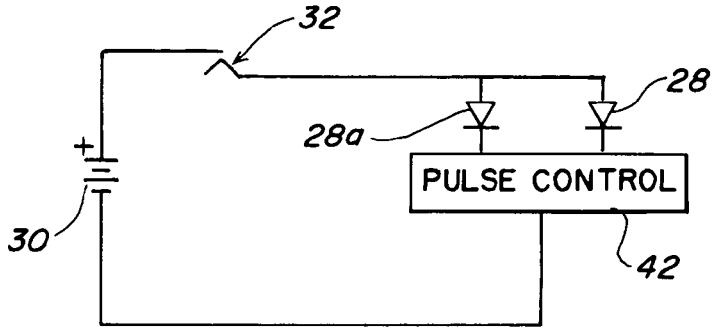
FIG. 5 is a schematic drawing of a circuit for causing two LEDs to independently and alternately blink.

LEDs 28*a*, 28*b* are connected to batteries 30*a*, 30*b* through a pulse control circuit 42. A simplified circuit for this purpose is shown in FIG. 5. In that arrangement, LEDs 28*a*, 28*b* are connected to battery 30 through pulse control circuit 42. Mechanism 32 for activating and deactivating LEDs 28*a*, 28*b* is shown in the form of a switch 32. Switch 32, as shown, is normally open such that LEDs 28*a*, 28*b* are not energized and there is no current drain on batteries 30*a*, 30*b* unless the user takes steps to close the switch. This simple expedient greatly extends the working life of power source 30.

Figure 6:
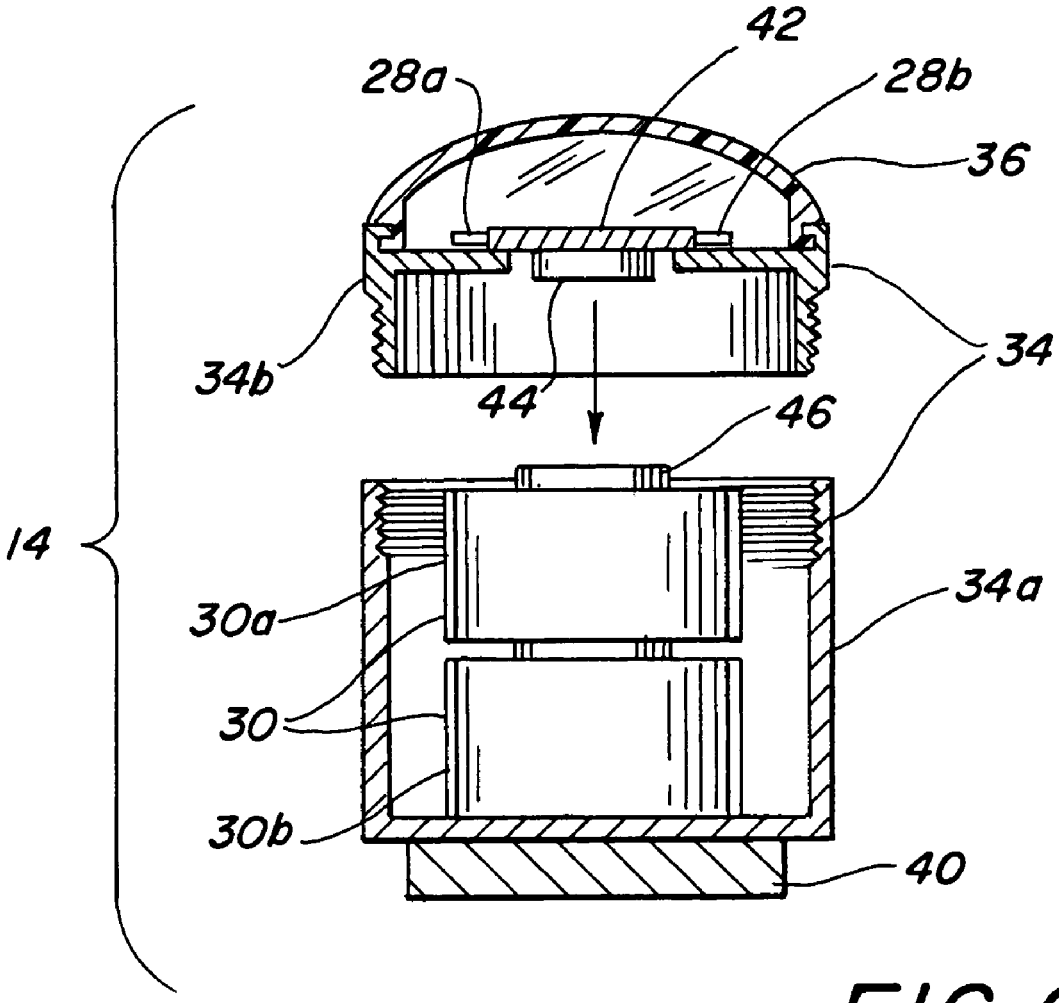
FIG. 6 is an exploded cross-section of an intermittent light source taken along the plane of 6-6 in FIG. 2.

Mechanism 32 for activating and deactivating LEDs 28*a*, 28*b* may take many forms, as will occur to those skilled in the art, including a push button or slide switch. As shown in FIG. 6, switch 32 is closed when upper compartment 34*b* is threaded into lower compartment 34*a*. In the embodiment shown in FIG. 6, pulse control circuit 42 is mounted in upper compartment 34*b* with a contact 44. Pulse control circuit 42 is energized when contact 44 engages a post 46 on upper battery 30*a* as upper compartment 34*b* is threaded into lower compartment 34*a*. The electrical circuit may be completed with suitable wiring connecting the opposite pole of battery 30*b* to pulse control circuit 42 or through upper and lower compartments 34*b*, 34*a* when they are formed of an electrically conductive material.

In the world of advertising and promotion, objects bearing a particular trademark, trade name, design or logo are often provided for heightening customer awareness of the business, establishment, product or service to which the name, design or logo relates. For example, in bars, restaurants and casinos, matchbooks, coasters, glassware, plasticware and the like are found bearing some form of identification to heighten customer awareness of the establishment or product being served. Signal device 10 can be made inexpensively enough to be used as a promotional item with the top surface of body 12 being ideally adapted for advertising purposes.

Figure 7:
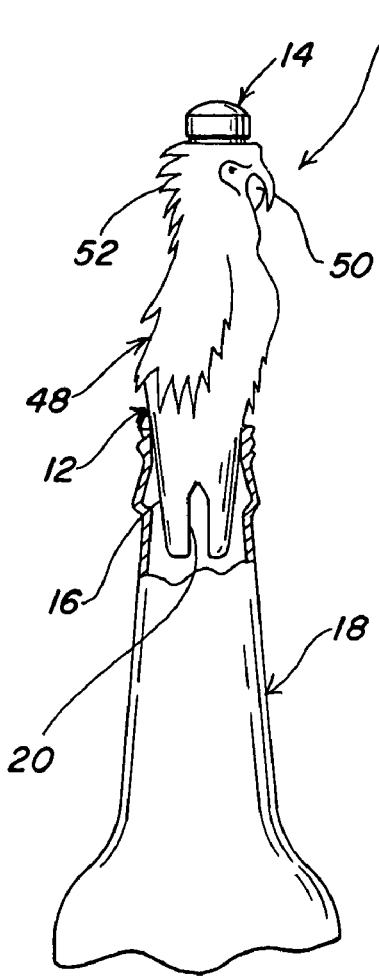
FIG. 7 is a side elevation of second signal device in accordance with the present invention inserted into the neck of a bottle.
Figure 8:
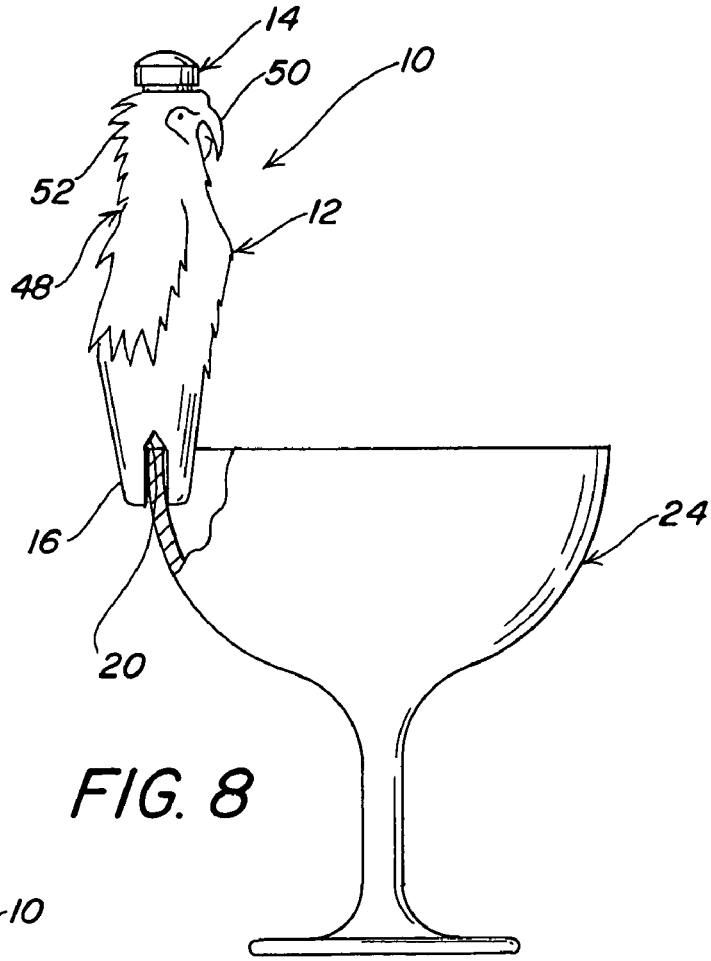
FIG. 8 is a side elevation showing the signal device of FIG. 7 perched on the rim of a glass; and, FIG. 9 is a side elevation of a third signal device in accordance with the present invention.
Figure 9:
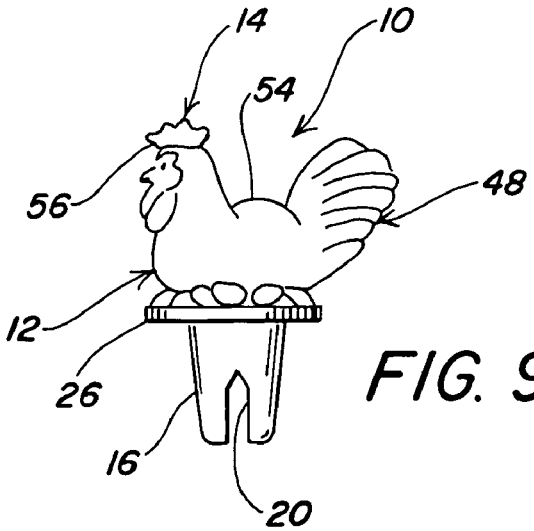

As shown in FIGS. 7-9, the top surface of body 12 may be decorated with a FIG. 48, symbol, character or the like. In FIGS. 7-8, body 12 is formed as a parrot 50 with its tail feathers serving as tapered base 16. Intermittent light source 14 is embedded in a head 52 of the bird. Body 12 is formed as a chicken 54 on a nest of eggs in FIG. 9 with intermittent light source 14 positioned in a comb 56 of the bird. Other FIG. 48, symbols, characters or the like may be used.

In use, signal device 10 is small enough that it can be carried in a purse or in a pocket. It may therefore be used in establishments where it is not provided. In those establishments where signal device 10 is provided, compartment 34 may be removed from body 12 and body 12 washed between uses and signal device 10 provided to the customer in a wrapper for aesthetic or sanitary reasons. Signal device 10 provides benefits to the proprietor, patron and service provider and, in addition to being utilitarian, is a novelty and just plain fun to use.

When signal device 10 is available and service is needed, it is not necessary for the patron to interrupt conversation while trying to wave down a service attendant. The operation of signal device 10 is quite simple; the user inserts base 16 into the neck of bottle 18 or perches it on rim 22 of glass 24 or drink container and closes switch 32 by an appropriate action. The blinking and moving light provided by spaced apart LEDs 28*a*, 28*b* draws attention to the user in a discrete but effective manner even when the service attendant has never encountered signal device 10 before.

Signal device 10 improves customer satisfaction and increases sales of other items, such as appetizers and desserts, because people tend to stay longer when they have a full drink. Signal device 10 decreases walk outs and early leaving of unsatisfied customers unable to attract the attention of a service attendant. Signal device 10 saves the service attendant trips as the server can see from across the room that the customer needs a drink and, in some instances, bring another round without approaching the table first. This saves the server work and may also increase the tips.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A signal device for use on a drinking vessel for signalling a service attendant to provide service, said signal device comprising a body with a tapered base adapted to fit into a neck of a beer bottle, said base attached to a flange large enough that the base cannot slip through the neck of the beer bottle, said base having a slot formed in the bottom of the base by which the body can be balanced on the rim of a drinking class;

a first compartment housing a power source;

a second compartment housing a plurality of light emitting diodes connected to a circuit board providing pulse control of the diodes such that they alternately flash at timed intervals, said circuit board being initially electrically insulated from the power source, said first and second compartments having means for connecting the power source and the circuit board to cause alternating flashing of the light emitting diodes in an attention generating manner for summoning a service attendant, said first and second compartments being cylindrical in shape, said first and second compartments having threads, the threads of one of said compartments cooperatively received in the threads of the other of said compartments whereby the power source is connected to the circuit board by threading one of first compartments into the other.

2. The signal device of claim 1 including a light transmitting dome over the light emitting diodes.

3. The signal device of claim 2 wherein the power source is a plurality of coin-shaped batteries linked in series.

* * * * *